US009037036B2

(12) United States Patent
Yamashita et al.

(10) Patent No.: US 9,037,036 B2
(45) Date of Patent: May 19, 2015

(54) OPENING AND CLOSING MECHANISM AND IMAGE-FORMING APPARATUS

(71) Applicant: CANON KABUSHIKI KAISHA, Tokyo (JP)

(72) Inventors: Masatoshi Yamashita, Tokyo (JP); Toshiharu Kawai, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/079,891

(22) Filed: Nov. 14, 2013

(65) Prior Publication Data

US 2014/0137372 A1 May 22, 2014

(30) Foreign Application Priority Data

Nov. 20, 2012 (JP) ..... 2012-254296
Nov. 6, 2013 (JP) ..... 2013-230190

(51) Int. Cl.

| | |
|---|---|
| ***G03G 15/00*** | (2006.01) |
| ***E05D 7/00*** | (2006.01) |
| ***E05D 15/00*** | (2006.01) |
| ***G03G 21/16*** | (2006.01) |
| ***E05D 3/02*** | (2006.01) |

(52) U.S. Cl.

CPC ..... *G03G 21/1633* (2013.01); *Y10T 16/52* (2015.01); *E05Y 2900/606* (2013.01); *E05D 3/02* (2013.01); *G03G 21/1647* (2013.01)

(58) Field of Classification Search

CPC ..... G03G 21/1647; Y10T 16/52; E05Y 2900/606

USPC ..... 399/107, 110, 124; 361/724; 312/326–329; 16/221, 362, 373

See application file for complete search history.

(56) References Cited

U.S. PATENT DOCUMENTS

| | | | | |
|---|---|---|---|---|
| 5,452,847 | A * | 9/1995 | Harris et al. | 229/125.11 |
| 7,684,731 | B2 * | 3/2010 | Hirose et al. | 399/124 |
| 2009/0212677 | A1 * | 8/2009 | Kocak et al. | 312/326 |
| 2011/0304250 | A1 * | 12/2011 | Ueda | 312/326 |
| 2013/0214663 | A1 * | 8/2013 | Marzorati | 312/400 |
| 2014/0055019 | A1 * | 2/2014 | Pletenetskyy et al. | 312/326 |
| 2014/0137372 | A1 * | 5/2014 | Yamashita et al. | 16/221 |

FOREIGN PATENT DOCUMENTS

JP 2005-327918 A 11/2005

* cited by examiner

*Primary Examiner* — W B Perkey

(74) *Attorney, Agent, or Firm* — Fitzpatrick, Cella, Harper & Scinto

(57) ABSTRACT

An opening and closing mechanism has an apparatus body 2 and an opening and closing member 3 that opens and closes by rotating with respect to the apparatus body 2, and also has a rod-like metal shaft member 8 that is mounted in the apparatus body 2. The opening and closing member 3 is rotatably supported about the metal shaft member 8 through insertion of the opening and closing member 3 between a guiding surface **7*a*1 having a circular arc surface shape provided in the apparatus body 2, and a surface 8*a* of the metal shaft member 8**.

18 Claims, 14 Drawing Sheets

OPENING AND CLOSING MECHANISM AND IMAGE-FORMING APPARATUS

BACKGROUND OF THE INVENTION

1. Field of the Invention

The present invention relates to an opening and closing mechanism of a door that openably and closably covers an opening of a casing, and an image forming apparatus that comprise the opening and closing mechanism.

2. Description of the Related Art

In conventional image-forming apparatuses, a photoconductor, as an image bearing member, is charged uniformly, and a latent image becomes formed on the photoconductor through selective exposure of the latter. The latent image on the photoconductor is developed by a developer, to become manifest in the form of a developer image that is thereafter transferred to a recording material.

Through application of heat and pressure to the transferred developer image, an image is recorded in that the developer image is fixed onto the recording material. The periphery of such an image-forming apparatus is conventionally covered by a casing, with an opening provided in part of the casing in order to replenish developer and perform maintenance of various process means. Preferably, such a casing opening is closed during everyday use, to secure safety and sound-proofing. Accordingly, the opening is ordinarily covered by a door that is supported on an apparatus body in such a manner that the door can be opened and closed (see Japanese Patent Application Publication No. 2005-327918).

FIGS. 14A, 14B are schematic diagrams illustrating the configuration of a casing of a conventional laser printer, as an example of such an image-forming apparatus. As illustrated in the figure, a dedicated opening 230 is provided, so as to enable replenishment of developer, in an apparatus body 202. At times other than during maintenance, the opening 230 is closed by a door 203 that is provided in the apparatus body 202. A pivot 250 that is formed protruding from both side end sections at one edge of the door 203 fits into a bearing portion (not shown) that is formed in the apparatus body. The door 203 is rotatably mounted thereby about the pivot 250. The door 203 allows keeping the opening 230 normally in a closed state, while during replenishment of developer, the opening 230 can be brought to an open state through rotation of the door 203.

As described above, a door opening and closing mechanism is conventionally resorted to wherein a hinge mechanism enables a rotation operation about a pivot that facilitates a smooth opening and closing operation.

However, a concern arises in that if such a hinge mechanism is used, the shape of the opening and closing door of the apparatus and the position of the hinge may be constrained in order to achieve the following configuration. This configuration is namely a configuration that precludes the occurrence of a large clearance between the door 203 and another casing exterior (exterior part 210) covering the apparatus body 202 upon closing of the opening 230, and that prevents the opening and closing operation of the door 203 from being hindered on account of interference between the door 203 and other constituent parts that are provided inside the apparatus body.

Demands concerning functionality at low cost and better design have been placed on image-forming apparatuses in recent years. To meet these demands, the added value of products has to be increased by making clearances between constituent parts as small as possible, while keeping costs down.

SUMMARY OF THE INVENTION

In the light of the above, it is an object of the present invention to reduce constraints in the design of an apparatus body and a door that openably and closably covers an opening of the apparatus body, and to enable a smooth opening and closing operation of the door.

It is a further object of the present invention to provide the opening and closing mechanism set forth below, and an image-forming apparatus that comprises the opening and closing mechanism.

An opening and closing mechanism, comprising:

an apparatus body;

an opening and closing member that opens and closes by rotating with respect to said apparatus body; and a rod-like metal shaft member that is mounted in said apparatus body;

wherein said opening and closing member is rotatably supported about said metal shaft member through insertion of said opening and closing member between a guiding surface having a circular arc surface shape provided in said apparatus body, and a surface of said metal shaft member.

An opening and closing mechanism, comprising:

an apparatus body; and first and second opening and closing members that open and close by rotating with respect to said apparatus body, wherein said apparatus body has first and second guiding surfaces having circular arc surface shapes respectively, said first opening and closing member has a first guided surface that contacts said first guiding surface and a first contact surface that contacts said second opening and closing member, and said second opening and closing member has a second guided surface that contacts said second guiding surface and a second contact surface that contacts said first opening and closing member, and wherein said first and second guiding surfaces, said first and second guided surfaces, and said first and second contact surfaces are formed in a concentric circular arc surface shape centered on a predetermined rotation center, and said first and second opening and closing members are rotatably supported about said predetermined rotation center through insertion of said first and second opening and closing members between said first and second guiding surfaces.

Further features of the present invention will become apparent from the following de script ion of exemplary embodiments (with reference to the attached drawings).

DESCRIPTION OF THE EMBODIMENTS

Modes for embodying the present invention will now be exemplified in detail with reference to the drawings. The dimensions, materials, and shapes of constituent parts, relative positions between the constituent parts, and the like described in the following embodiments are to be modified as appropriate in accordance with the configuration of an apparatus to which the present invention is to be applied and in accordance with various other conditions, and do not limit the scope of the present invention to the following embodiments.

The present invention relates to an opening and closing mechanism of a door that openably and closably covers an opening of a casing. In particular, the present invention relates to a casing of an image-forming apparatus such as a copier, printer or the like. An electrophotographic image forming apparatus that utilizes an electrophotographic system will be explained as an image-forming apparatus in the present embodiment. As used herein, the term electrophotographic image forming apparatus denotes an apparatus in which images are formed on a recording medium using an electrophotographic system. Examples of the electrophotographic image forming apparatus include, for instance, electrophotographic copiers, electrophotographic printers (for instance, laser beam printers, LED printers or the like), fax machines, word processors and the like.

Embodiment 1

Embodiment 1 is explained below.

In the present embodiment a full-color image-forming apparatus having four detachable process cartridges is exemplified as an image-forming apparatus. However, the number of process cartridges that are attached in the image-forming apparatus is not limited thereto, and may be appropriately set as needed. For instance, one process cartridge is attached in the image-forming apparatus in the case of an image-forming apparatus where monochrome images are formed.

In the present embodiment a printer will be exemplified as one aspect of the image-forming apparatus. However, the image-forming apparatus in which the present invention can be used is not limited thereto, and may be, for instance, another image-forming apparatus such as a copier, a fax machine, or a multifunction machine that combines these functions.

<Schematic Configuration of the Image-Forming Apparatus>

Figure 1:
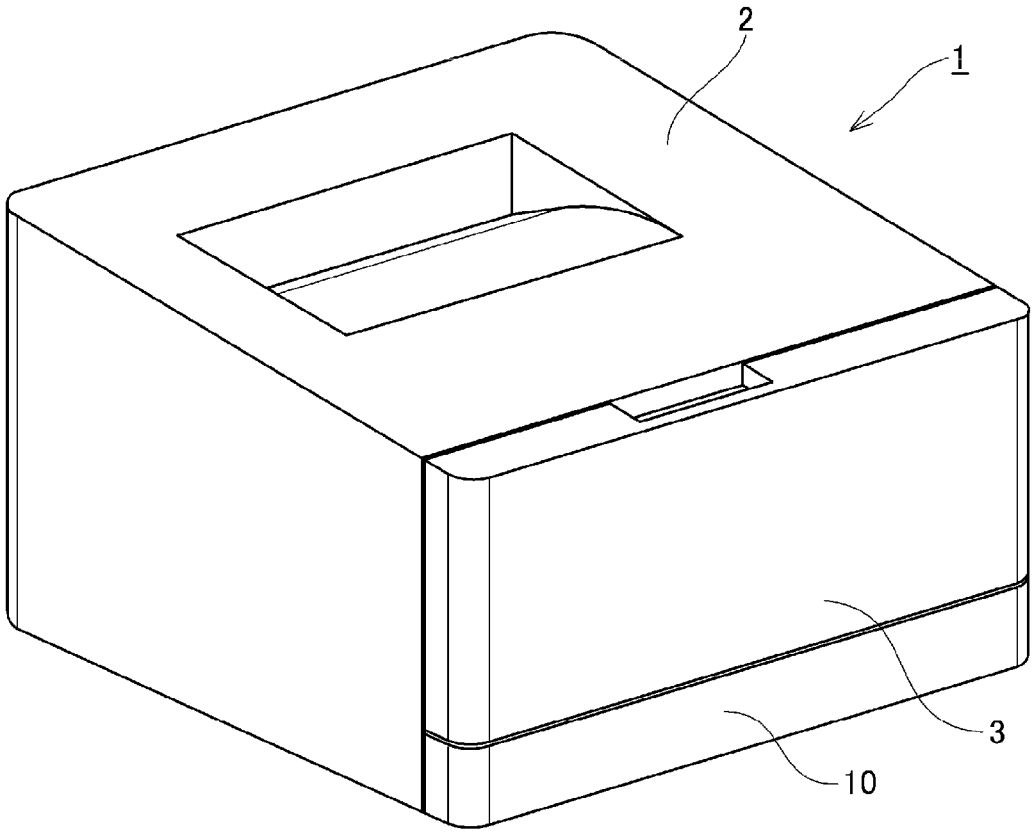
FIG. 1 is a schematic perspective-view diagram illustrating the exterior of an image-forming apparatus of Embodiment 1.
Figure 2:
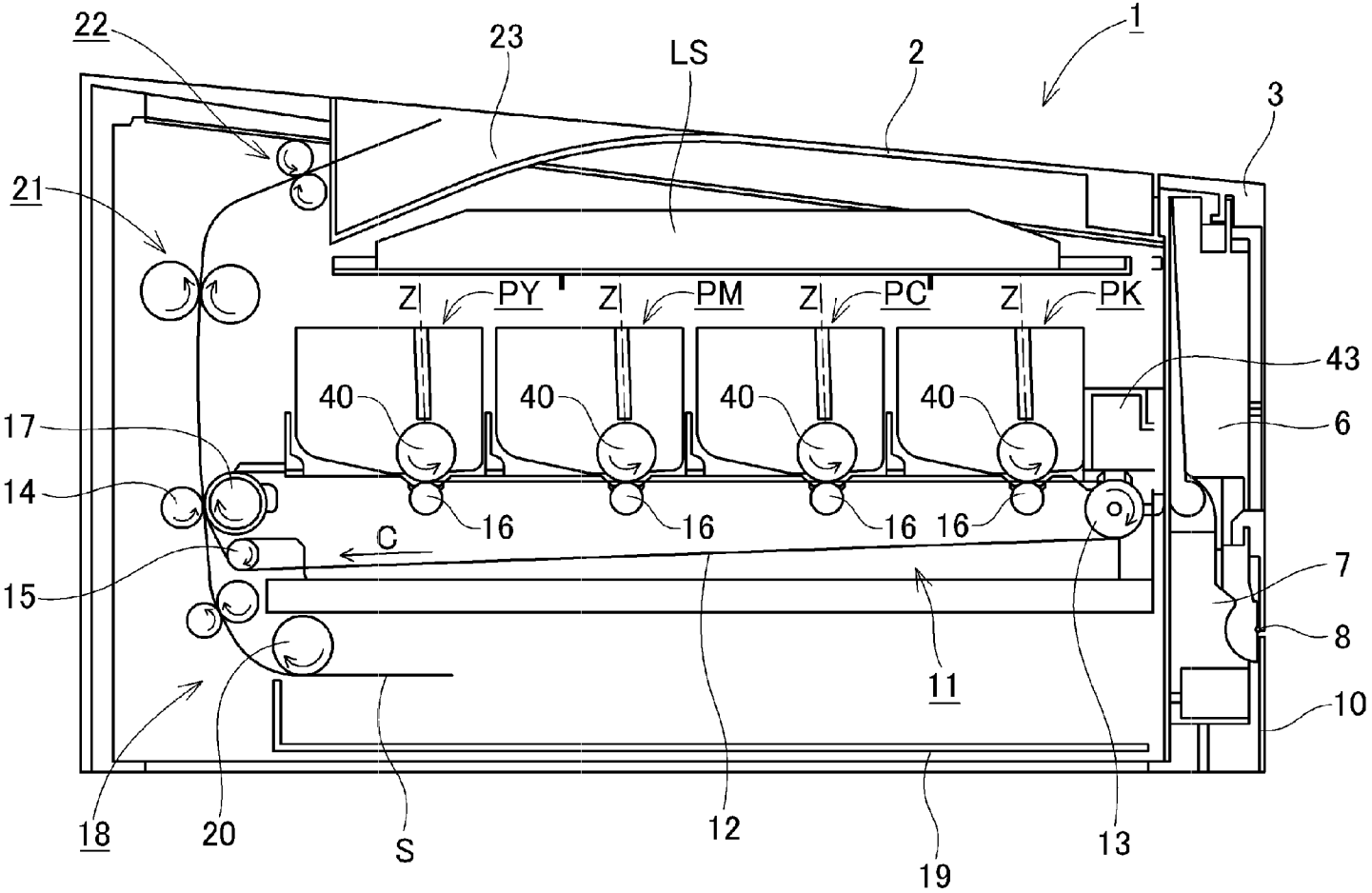
FIG. 2 is a cross-sectional diagram illustrating the schematic configuration of the image-forming apparatus of Embodiment 1.

FIG. 1 is a schematic perspective-view diagram illustrating the exterior of the image-forming apparatus of the present embodiment. FIG. 2 is a cross-sectional diagram illustrating the schematic configuration of the image-forming apparatus of the present embodiment.

The image-forming apparatus 1 of the present embodiment is a four-color full-color laser printer that utilizes an electrophotographic process, and that forms a color image on a recording material. The image-forming apparatus 1 is of process cartridge type wherein process cartridges (hereafter, cartridges) P are removably attached to an apparatus body 2, and a color image is formed on a recording material S.

As termed herein, the front face (front) of the image-forming apparatus 1 denotes the side at which a door (opening and closing member) 3 is provided that covers openably and closably an opening 30 of the apparatus body 2, and a rear face (back face) denotes the face, in the image-forming apparatus 1, opposite the front face. Further, up and down denote up and down in the vertical direction in a state where the image-forming apparatus 1 is in an installed condition (in use). The door 3 makes up the front face-side exterior (exterior surface) of the image-forming apparatus 1 that is provided with a cover (cover member) 3*a*. An exterior part (cassette cover in the present embodiment) 10 is disposed below the door 3, juxtaposed with the latter, in such a way so as to make up a front face-side exterior together with the door 3. Four cartridges P (PY•PM•PC•PK), namely a first cartridge PY, a second cartridge PM, a third cartridge PC and a fourth cartridge PK are disposed, in the horizontal direction, in the apparatus body 2 of the image-forming apparatus 1.

The first through fourth cartridges P (PY•PM•PC•PK) have an identical electrophotographic process mechanism, but the respective developers (toners) have mutually dissimilar colors. In the explanation below, therefore, the suffixes Y, M, C, K that are appended to the symbol P to denote an element provided for any of the colors will be omitted, and the elements will be explained collectively unless specific differentiation among them is called for.

A rotational driving force from a driving output portion (not shown) of the apparatus body 2 is transmitted to each cartridge P. Further, bias voltage (charging bias, developing bias and so forth) is supplied (omitted in the figures) from the apparatus body 2 to each cartridge P.

The first cartridge PY holds yellow (Y) toner and forms a yellow toner image on the surface of a respective photoconductor (photosensitive drum) 40, as an image bearing member. The second cartridge PM holds magenta (M) toner and forms a magenta toner image on the surface of a respective photoconductor 40. The third cartridge PC holds cyan (C) toner and forms a cyan toner image on the surface of a respective photoconductor 40. The fourth cartridge PK holds black (K) toner and forms a black toner image on the surface of a respective photoconductor 40.

A laser scanner unit LS, as exposure means, is provided above the cartridges P. The laser scanner unit LS outputs a respective laser beam Z, corresponding to image information for each color, towards each photoconductor 40. The surface of each photoconductor 40 is scanned and exposed by the respective laser beam Z, through a respective exposure window of each cartridge P.

An intermediate transfer belt unit 11 is provided, as a transfer member, below the cartridges P. The intermediate transfer belt unit 11 has a driver roller 13, a turn roller 17 and a tension roller 15, and a flexible transfer belt 12 that is wrapped around these rollers.

Each photoconductor 40 of the first through fourth cartridges P (PY•PM•PC•PK) is configured so that the lower face of the photoconductor 40 comes into contact with the top face of the transfer belt 12. The contact portion (contact region) of the transfer belt 12 and each photoconductor 40 constitutes a primary transfer portion. A respective primary transfer roller 16 is provided, inward of the transfer belt 12, opposite each photoconductor 40.

A secondary transfer roller 14 contacts the turn roller 17 via the transfer belt 12. The contact portion of the transfer belt 12 and the secondary transfer roller 14 constitutes a secondary transfer portion.

A feeding unit 18 is provided below the intermediate transfer belt unit 11. The feeding unit 18 has a feeding tray 19 on which the recording material S is stacked and accommodated, and a feeding roller 20.

In FIG. 2, a fixing unit 21 and a discharge unit 22 are provided at the top left inside the apparatus body 2, and a discharge tray 23 is provided at the top face of the apparatus body 2.

The recording material S has a toner image fixed thereonto by fixing means provided in the fixing unit 21, and is thereafter discharged onto the discharge tray 23.

<Image-Forming Operation>

The image-forming operation in which a full-color image is formed will be explained next.

The photoconductor 40 of each cartridge P is rotationally driven (arrow direction in FIG. 2 (counterclockwise in FIG. 2)) at a predetermined speed. The transfer belt 12 as well is rotationally driven at a speed corresponding to the speed of the photoconductor 40 in a direction (direction of arrow C in FIG. 2) that is the forward direction of the rotation of the photoconductors 40.

The laser scanner unit LS performs scanning exposure, by way of the laser beams Z, of the surface of each photoconductor 40, in accordance with image signals of the respective colors. A respective electrostatic latent image becomes formed as a result according to the image signal of the corresponding color, on each photoconductor 40. The formed electrostatic latent image is developed by a developing roller (not shown) that is rotationally driven at a predetermined speed.

As a result of such a formation process of an electrophotographic image, a yellow toner image corresponding to the yellow component of a full-color image is formed on the photoconductor 40 of the first cartridge PY. The toner image is primary-transferred to the transfer belt 12, at the primary transfer portion.

Similarly, a magenta toner image corresponding to the magenta component of the full-color image is formed on the photoconductor 40 of the second cartridge PM. This toner image is primary-transferred, at the primary transfer portion, in such away so as to be superimposed on the yellow toner image that has already been transferred to the transfer belt 12.

Similarly, a cyan toner image corresponding to the cyan component in the full-color image is formed on the photoconductor 40 of the third cartridge PC. This toner image is primary-transferred, at the primary transfer portion, in such away so as to be superimposed on the yellow and magenta toner images that have al ready been transferred to the transfer belt 12.

Similarly, a black toner image corresponding to a black component in the full-color image is formed on the photoconductor 40 of the fourth cartridge PK. This toner image is primary-transferred, at the primary transfer portion, in such a way so as to be superimposed on the yellow, magenta and cyan toner images that have already been transferred to the transfer belt 12.

A four-color full-color unfixed toner image of yellow, magenta, cyan and black is thus formed on the transfer belt 12.

Meanwhile, the recording material S is separated and fed, sheet by sheet, at a predetermined control timing. The recording material S is introduced, at a predetermined control timing, into the secondary transfer portion between the secondary transfer roller 14 and the transfer belt 12.

As a result, the four-color superposed toner image on the transfer belt 12 is sequentially batch-transferred to the surface of the recording material S, in the process whereby the recording material S is transported to the secondary transfer portion.

<Attachment and Detachment of Cartridges>

The attachment and detachment operation of the cartridges P to/from the apparatus body 2 is explained next.

Figure 3A:
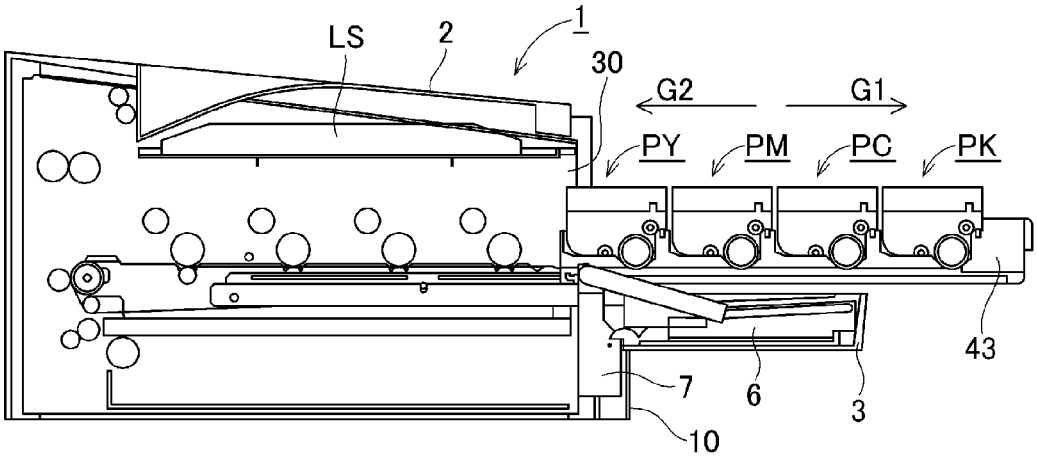
FIG. 3A is a set of diagrams illustrating a state where a cartridge tray of Embodiment 1 is pulled out of an apparatus body.
Figure 3B:
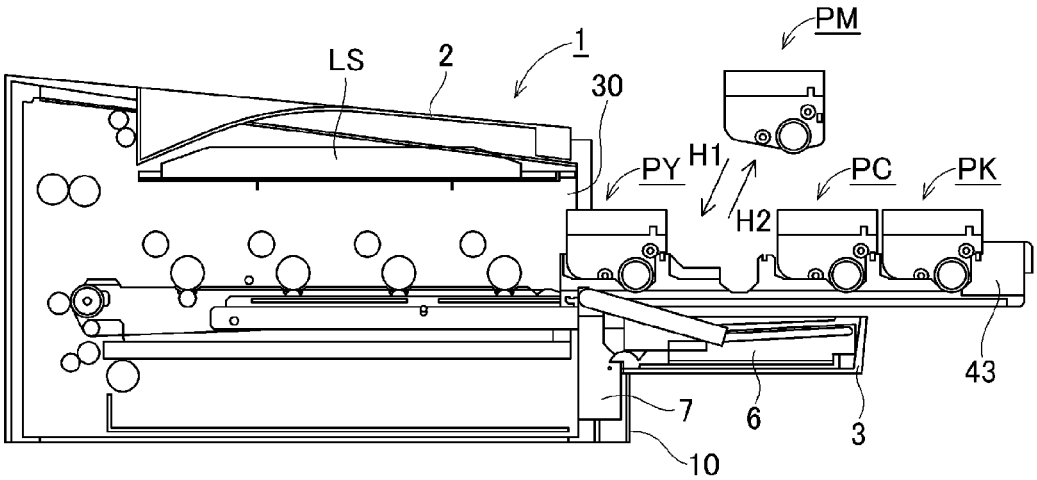
FIG. 3B is a set of diagrams illustrating a state where a cartridge tray of Embodiment 1 is pulled out of an apparatus body.

FIG. 3A is a schematic cross-sectional diagram illustrating a cartridge tray 43 having been pulled out of the apparatus body 2, with the cartridges P in a detachable state. FIG. 3B is a schematic cross-sectional diagram illustrating an attachment and detachment operation of the cartridges P to/from the cartridge tray 43.

The cartridge tray 43 onto which the cartridges P can be attached is provided in the apparatus body 2. As illustrated in FIG. 3A, the cartridge tray 43 is configured so as to be capable of moving (being pulled out/pushed in) in direction G1 (front face direction) and direction G2 (rear face direction) that are substantially horizontal directions with respect to the apparatus body 2. As a result, the cartridge tray 43 can occupy an attached position in the apparatus body 2, and a draw-out position arrived at through pulling from the attached position.

The attaching operation of a cartridge P onto the apparatus body 2 will be explained first.

The door 3 of the apparatus body 2 is opened, and the cartridge tray 43 is displaced in the direction of arrow G1 in FIG. 3A, as a result of which the cartridge tray 43 moves to the draw-out position. In this state, the cartridge P is attached to the cartridge tray 43, in the direction of arrow H1 of FIG. 3B, and is held on the cartridge tray 43.

The cartridge tray 43 having the cartridge P held thereon is moved in the direction of arrow G2 in FIG. 3A, whereupon the cartridge tray 43 is displaced to the attached position in the apparatus body 2. The door 3 is then closed, to complete thereby the attaching operation of the cartridge P to the apparatus body 2.

The operation of retrieving a cartridge P from the apparatus body 2 will be explained next.

In the same way as in the above-described attaching operation of the cartridge P to the apparatus body 2, the cartridge tray 43 is displaced to the draw-out position. In this state, the cartridge P is retrieved in the direction of arrow H2 in FIG. 3B. This completes the retrieval operation of the cartridge P from the apparatus body 2. The cartridge P can thus be attached and detached to/from the apparatus body 2 as a result of the above operations.

<Door Hinge Configuration>

The hinge configuration of the door 3, which makes the door 3 rotatable with respect to the apparatus body 2, will be explained next.

Figure 4A:
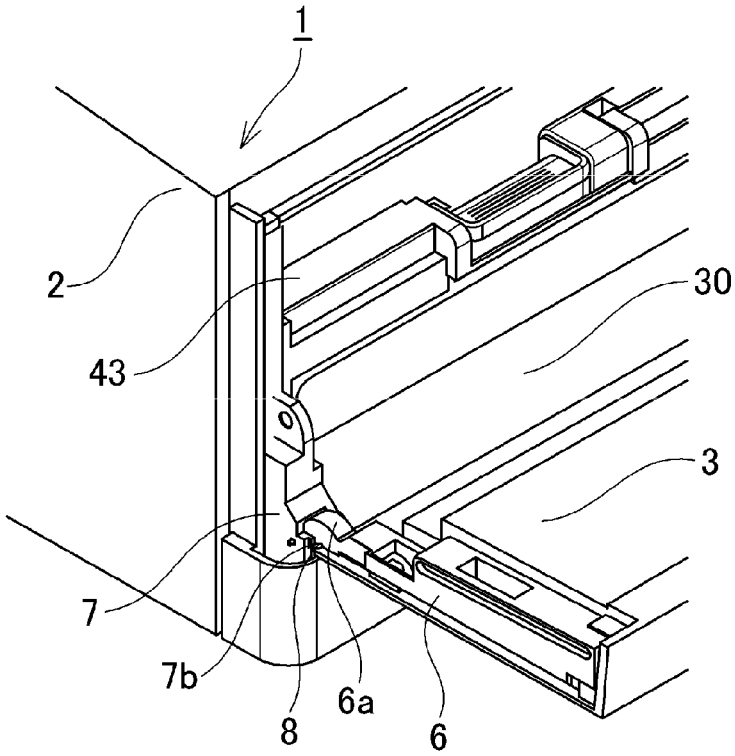
FIG. 4A is a set of schematic perspective-view diagrams illustrating a hinge portion, with a door of Embodiment 1 in an open state.
Figure 4B:
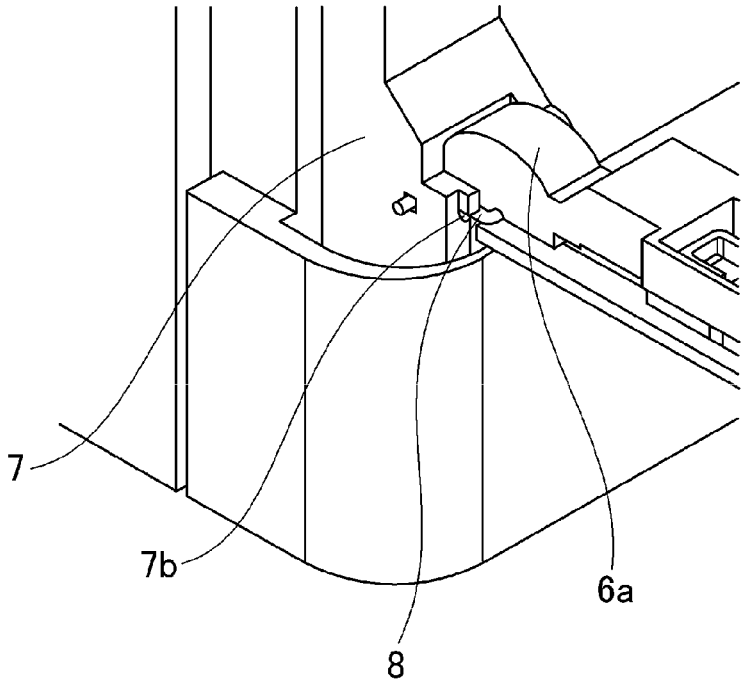
FIG. 4B is a set of schematic perspective-view diagrams illustrating a hinge portion, with a door of Embodiment 1 in an open state.
Figure 5A:
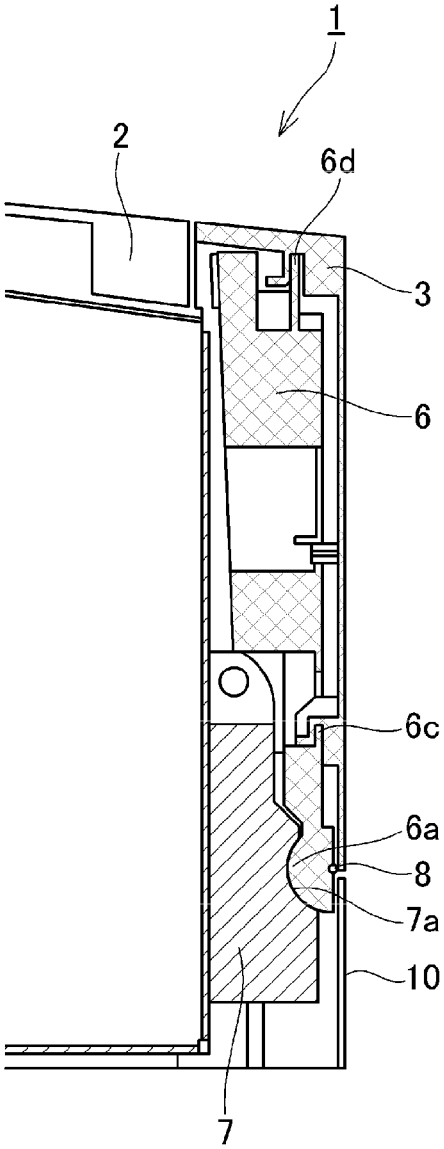
FIG. 5A is a set of schematic cross-sectional diagrams illustrating a hinge portion with the door of Embodiment 1 in a closed state.
Figure 5B:
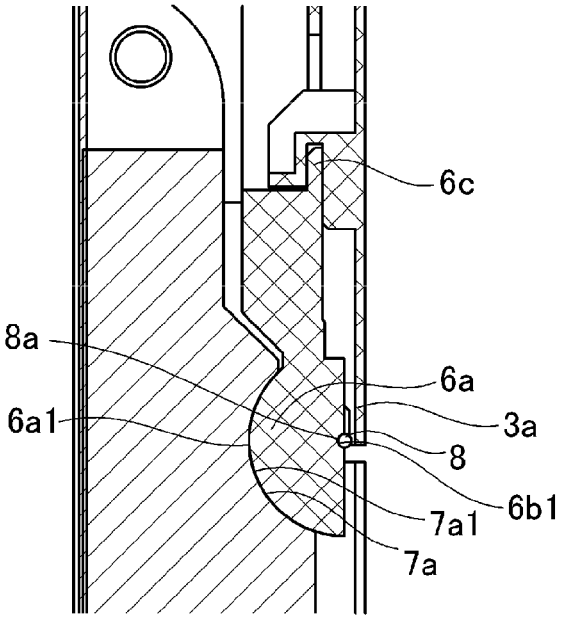
FIG. 5B is a set of schematic cross-sectional diagrams illustrating a hinge portion with the door of Embodiment 1 in a closed state.
Figure 6A:
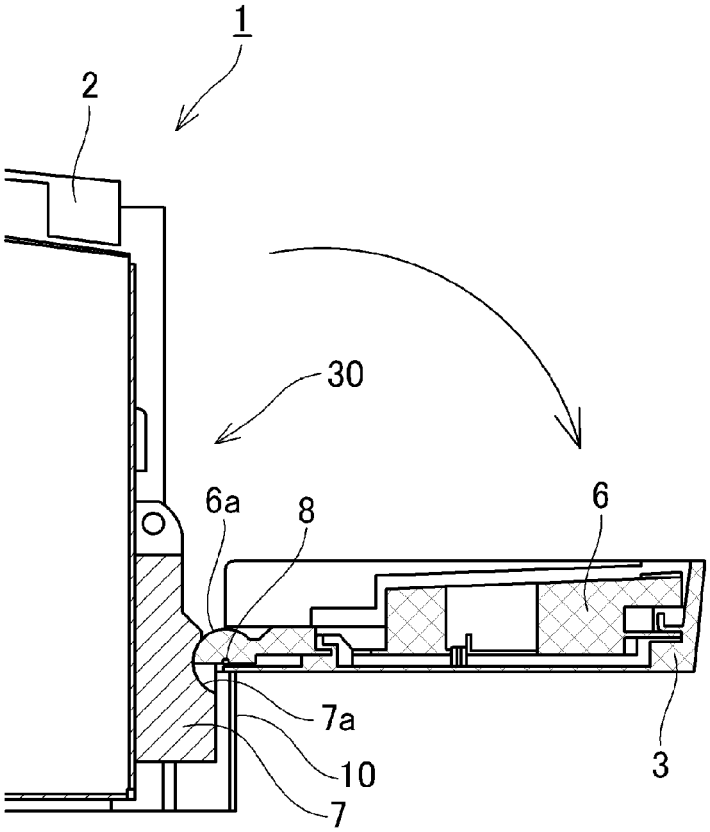
FIG. 6A is a set of schematic cross-sectional diagrams illustrating a hinge portion with the door of Embodiment 1 in an open state.
Figure 6B:
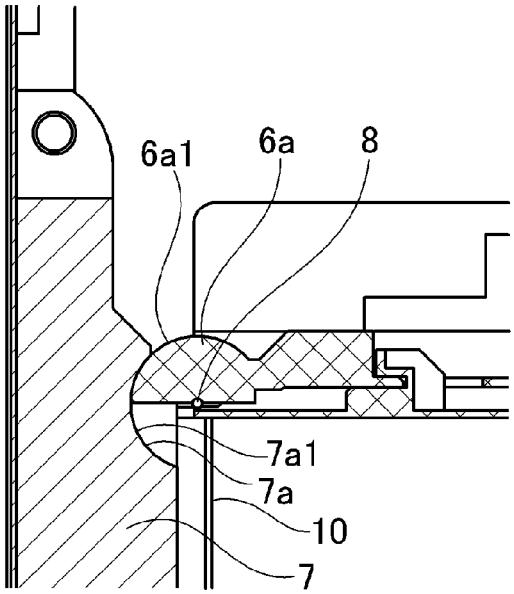
FIG. 6B is a set of schematic cross-sectional diagrams illustrating a hinge portion with the door of Embodiment 1 in an open state.

FIG. 4A is a schematic perspective-view diagram illustrating a hinge portion with the door 3 in an open state, with part of the door 3 cut away. FIG. 4B is an enlarged diagram of the hinge portion illustrated in FIG. 4A. FIG. 5A is a schematic cross-sectional diagram illustrating the hinge portion with the door 3 in a closed state. FIG. 5B is an enlarged diagram of the hinge portion illustrated in FIG. 5A. FIG. 6A is a schematic cross-sectional diagram illustrating the hinge portion with the door 3 in an open state. FIG. 6B is an enlarged diagram of the hinge portion illustrated in FIG. 6A. As illustrated in FIG. 4 through FIG. 6, a support member 7 on which the door 3 is rotatably supported is mounted on the apparatus body 2. The support member 7 is provided with a depressed portion 7*a* the cross-section whereof is of circular arc shape (in the present embodiment, of substantially half-moon shape (substantially semicircular shape)).

The door 3 is provided with a door hinge member 6 having a protruded portion 6*a* the cross-section whereof is of circular arc shape (in the present embodiment, of substantially half-moon shape), and with engaging protrusions 6*c*, 6*d*. The door hinge member 6 is fixed to the door 3 using the engaging protrusions 6*c*, 6*d*. The circular arc-shaped protruded portion 6*a* of the door hinge member 6 is rotatably engaged to, and supported on, the circular arc-shaped depressed portion 7*a* of the support member 7. Herein, the support member 7 corresponds to a body-side member that makes up a hinge portion. The door hinge member 6 corresponds to a door-side member that makes up a hinge portion. Herein, the feature wherein the cross-section of the depressed portion 7*a* and the protruded portion 6*a* is of circular arc shape refers to a feature wherein the shapes of the cross-sections, of the depressed portion 7*a* and the protruded portion 6*a*, perpendicular to a rotation axis about which the door hinge member 6 (door 3) rotates with respect to the apparatus body 2, are circular arc shapes. The protruded portion 6*a* is configured (formed) so as to bulge towards the apparatus body 2 with the door 3 in a closed state with respect to the apparatus body 2. Further, an outer peripheral face (a circular arc surface shaped first guided surface) 6*a*1 of the protruded portion 6*a* rotatably contacts an inner peripheral face (a circular arc surface shaped guiding surface) 7*a*1 of the depressed portion 7*a*, as a result of which the protruded portion 6*a* and the depressed portion 7*a* engage each other, and the door 3 is brought to a state of being rotatably supported on the apparatus body 2.

A wire member (metal shaft member) 8, configured (disposed) coaxially (i.e. so as to have the same rotation axis (rotation center) as) with the circular arc-shaped protruded portion 6*a* of the door hinge member 6 and with the circular arc-shaped depressed portion 7*a* of the support member 7, is held on the support member 7. The wire member 8 holds the door hinge member 6 in such a manner that the engaged state of the protruded portion 6*a* of the door hinge member 6 and the depressed portion 7*a* of the support member 7 is not released (in such a manner that the protruded portion 6*a* and the depressed portion 7*a* do not come off each other). The door hinge member 6 is provided with a second guided surface 6*b*1 that contacts, and is guided by, a surface 8*a* of the wire member 8.

Herein, the wire member 8 corresponds to a shaft member that makes up a hinge portion and that rotatably connects the door hinge member 6 to the support member 7. The outer peripheral face 6*a*1, the second guided surface 6*b*1, the inner peripheral face 7*a*1 and the surface 8*a* of the wire member 8 are circular arc surfaces centered on the axis line of the wire member 8.

The orientation of the wire member 8 is fixedly supported by virtue of a configuration wherein the wire member 8 thrusts into a hole 7*b* that is provided in the support member 7. The cover 3*a* of the door 3 covers a position opposite the second guided surface 6*b*1, across the wire member 8, and prevents the second guided surface 6*b*1 from moving away from the wire member 8, and the door 3 from coming off the apparatus body 2.

By virtue of the above-described configuration, the door 3 can execute a smooth opening and closing operation, with respect to the apparatus body 2, through pivoting about the rotation shaft (axis line of the wire member 8) formed by the protruded portion 6*a*, the depressed portion 7*a* and the wire member 8 (i.e. by rotating about the wire member 8).

The effect of a door hinge mechanism of the present embodiment will be explained next.

Figure 7A:
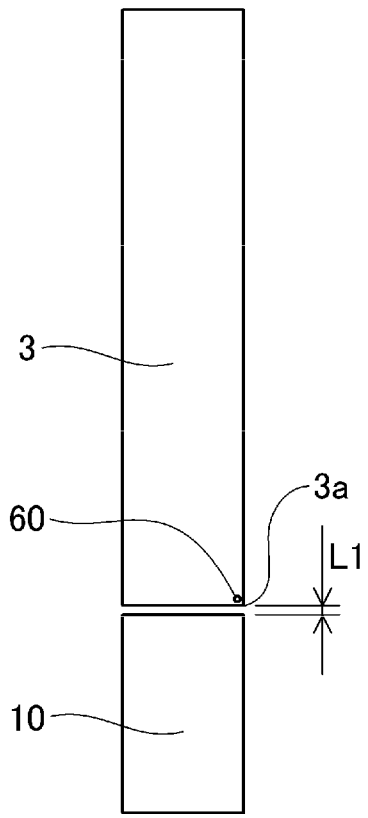
FIG. 7A is a set of diagrams for explaining an open and a closed state of a door that uses a door hinge mechanism of Embodiment 1.
Figure 14A:
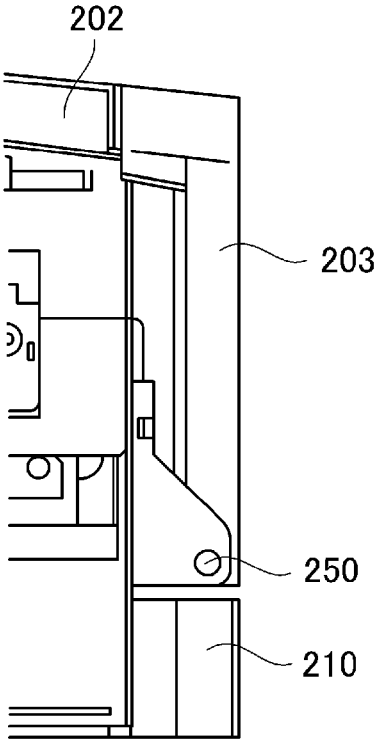
FIG. 14A is a set of diagrams for explaining an open and a closed state of a door that utilizes a conventional door hinge mechanism.
Figure 14B:
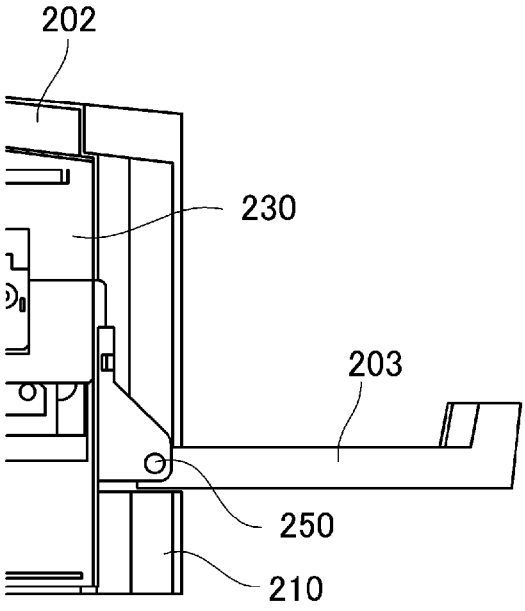
FIG. 14B is a set of diagrams for explaining an open and a closed state of a door that utilizes a conventional door hinge mechanism.
Figure 14C:
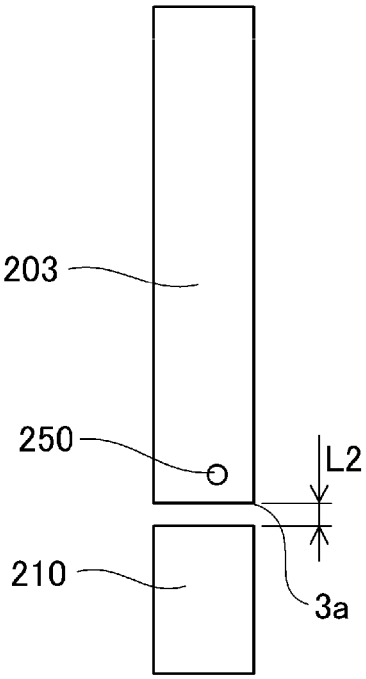
FIG. 14C is a set of diagrams for explaining an open and a closed state of a door that utilizes a conventional door hinge mechanism.
Figure 14D:
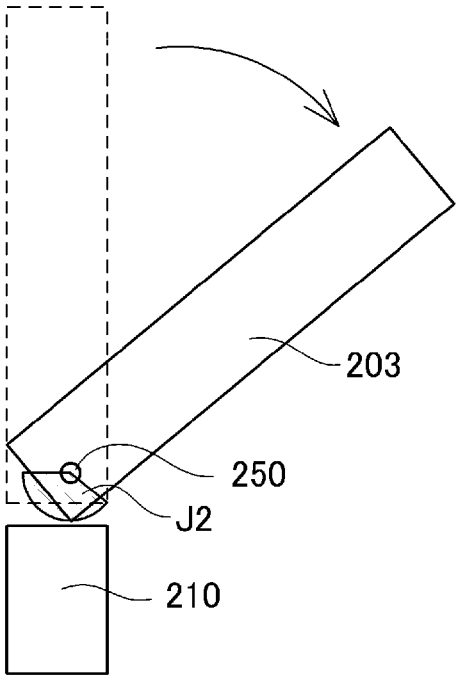
FIG. 14D is a set of diagrams for explaining an open and a closed state of a door that utilizes a conventional door hinge mechanism.

FIGS. 14C, 14D are schematic cross-sectional diagrams for explaining the open and closed state of a door that utilizes a conventional door hinge mechanism. FIGS. 7C, 7D are schematic cross-sectional diagrams for explaining the open and closed state of a door 3 that utilizes the door hinge mechanism of the present embodiment. For convenience, constituent members illustrated in FIGS. 14C, 14D that are identical to constituent members of the present invention are denoted with the same symbols as in the present embodiment.

As illustrated in FIGS. 14C, 14D, the pivot 250 of the conventional door 203, the pivot 250 being formed protruding from both side end sections at one edge (the lower end section in the figure), fits into a bearing portion (not shown) of the apparatus body, such that the door 203 is mounted so as to be rotatable about this pivot 250. The conventional pivot 250 had to be somewhat thick since it bears the entire load from the door 203, and is also acted upon by bending moment.

When the door 203 is open, as illustrated in FIG. 14D, one end section 203*a* of the door 203 gets into the interior of the apparatus body. Therefore, a concern arose in that a constraint might apply whereby no other constituent part can be disposed within the region of a rotation trajectory J2 of the one end section 203*a* of the door 203, with a view to preventing the opening and closing operation from being hindered on account of interference between the door 203 and other constituent parts that are provided inside the apparatus body.

Further, a large enough clearance had to be secured so as to avoid an interference region of the rotation trajectory J2, also for the clearance L2 with the exterior part 210.

By contrast, the door hinge mechanism of the present embodiment is configured in such a manner that the wire member 8 is acted upon mainly by tensile forces, and does not bear directly the full load of the door 3.

Although the support member 7 supports the door 3 (load of the door 3), the door 3 can be supported (the load of the door 3 can be borne) by the circular arc-shaped depressed portion 7*a* having a larger radius than that of a conventional pivot 250. Therefore, the support member boasts greater strength than that afforded by a conventional configuration where support is elicited by the pivot 250.

Ordinary members withstand tensile forces better than bending moment.

The diameter of the wire member 8 can therefore be made smaller in the present embodiment. Further, the wire member 8 can be made yet stronger by forming the wire member 8 out of strong material different from that of the exterior, for instance out of metal, and hence the diameter of the wire member 8 can be made smaller.

Figure 7B:
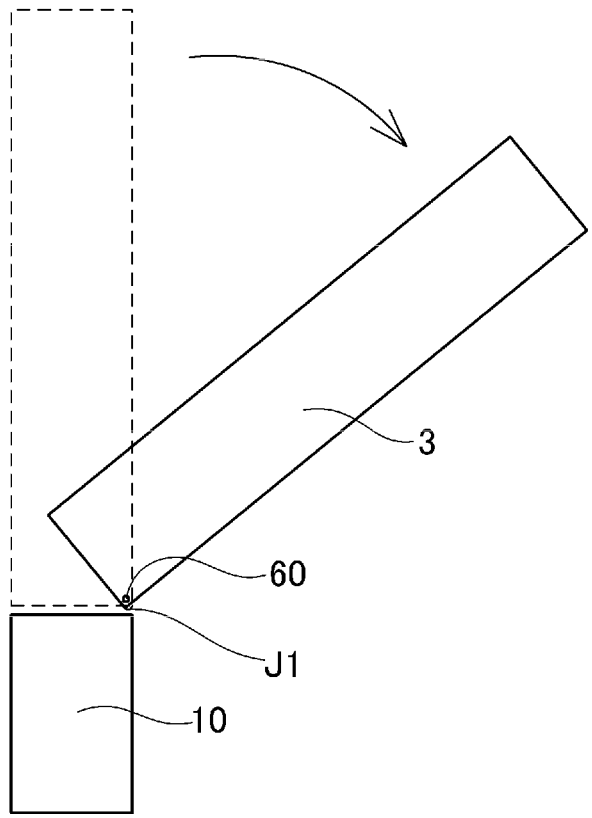
FIG. 7B is a set of diagrams for explaining an open and a closed state of a door that uses a door hinge mechanism of Embodiment 1.

Therefore, the rotation shaft 60 of the door hinge mechanism of the present embodiment can be disposed in the vicinity of the outer edge of the apparatus body 2, as illustrated in FIG. 7. It becomes possible as a result to make the rotation trajectory J1, along which the door 3 moves into the interior of the apparatus body when the door 3 is opened and closed, smaller than a rotation trajectory J2 of the conventional door, as illustrated in FIG. 7B.

Accordingly, no constraints need be imposed on the relationship between the position of the hinge and the arrangement of other constituent parts that are provided in the apparatus body 2. Hence, the door 3 can execute a smooth opening and closing operation, and the size of the apparatus body 2 can be reduced. Further, a clearance L1 with respect to the adjacent exterior part (exterior member) 10 can be made smaller than the conventional clearance L2. The exterior of the apparatus body can therefore be further improved.

As explained above, the present invention allows performing a smooth door opening and closing operation without imposing any constrains on the design of the apparatus body and the door. In particular, the present embodiment allows arranging the door opening and closing mechanism inside the apparatus body without affecting the design of the apparatus body, and allows setting the rotation shaft of the door in the vicinity of the exterior surface of the image-forming apparatus (casing). Accordingly, the door can execute an opening and closing operation without interfering with constituent parts inside the apparatus body, and clearances with exterior parts can be made smaller than in conventional configurations. The exterior of the image-forming apparatus can be further improved as a result.

Embodiment 2

Embodiment 2 is explained next.

In addition to the configuration of Embodiment 1, a manual feeding unit 24 is also provided in the present embodiment on the front face side (outward of the door 3) of the apparatus body 2. Specifically, the door of the present embodiment has a double-structure configuration, such that the door (first opening and closing member) 3 that covers the opening 30 of the apparatus body 2 and the manual feeding door (second opening and closing member) 4 that is a placing portion (loading portion) of recording material at the time of a manual feeding operation are rotatably supported on the apparatus body 2. The door 3 corresponds to a first door, and the opening 30 corresponds to a first opening. The manual feeding door 4 corresponds to a second door. An opening 31 through which the recording material passes when transported (inserted, thrust) into the apparatus body 2 from outside the latter, during a manual feeding operation, corresponds to a second opening. Constituent members and parts shared with those of Embodiment 1 will be denoted with shared symbols, and an explanation thereof will be omitted. The schematic configuration of the image-forming apparatus, the image-forming operation, as well as the cartridge attachment and detachment configuration are identical to those of Embodiment 1, and a recurrent explanation thereof will be likewise omitted herein.

<Manual Feeding Configuration>

A manual feeding operation will be explained first.

Figure 8:
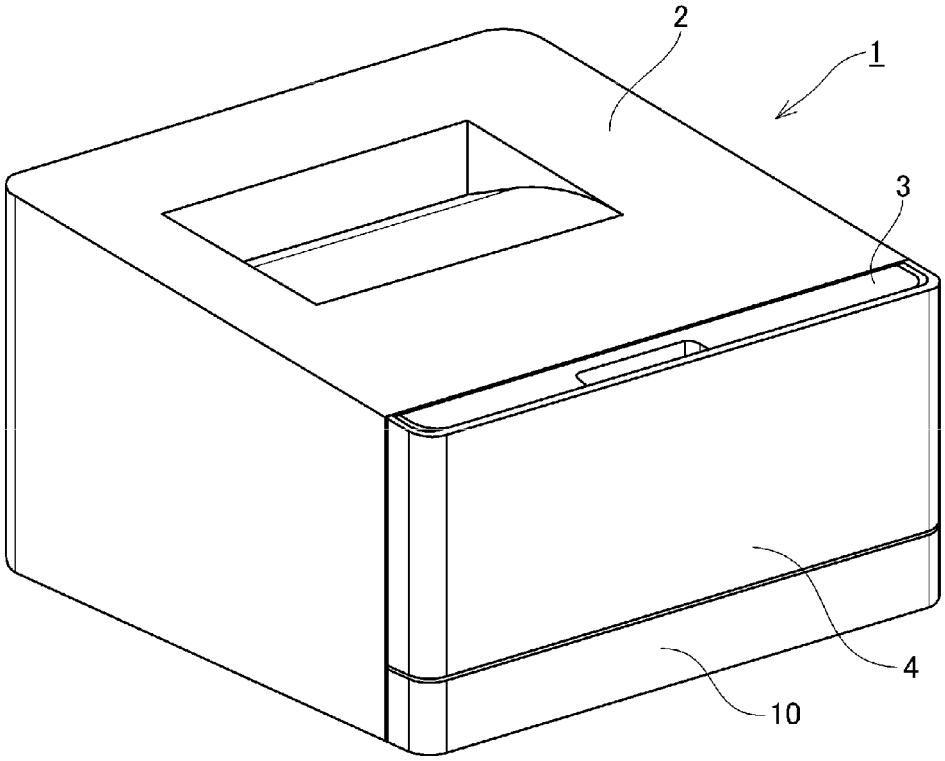
FIG. 8 is a schematic perspective-view diagram illustrating the exterior of an image-forming apparatus of Embodiment 2.
Figure 9:
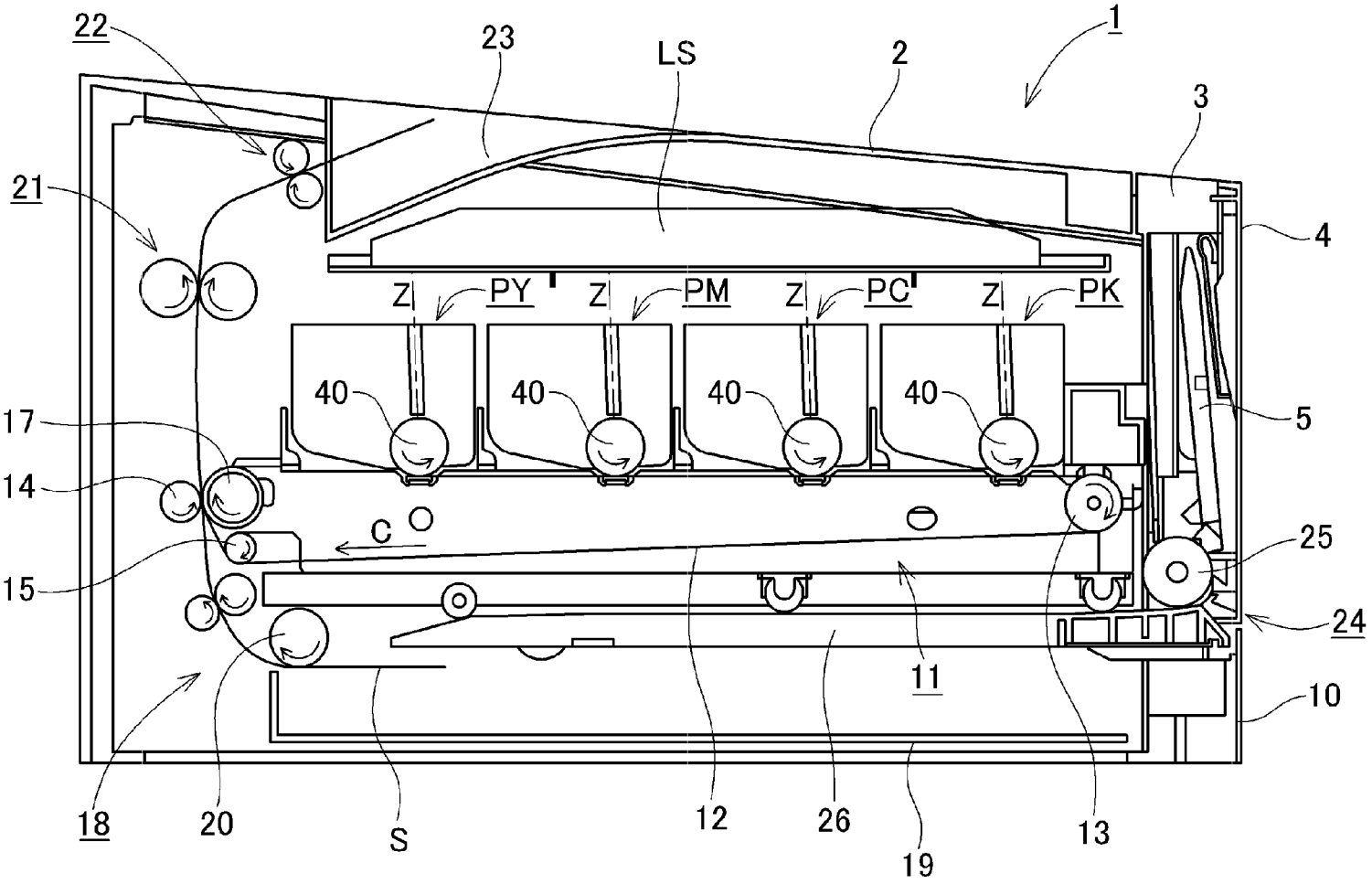
FIG. 9 is a cross-sectional diagram illustrating the schematic configuration of the image-forming apparatus of Embodiment 2.
Figure 10:
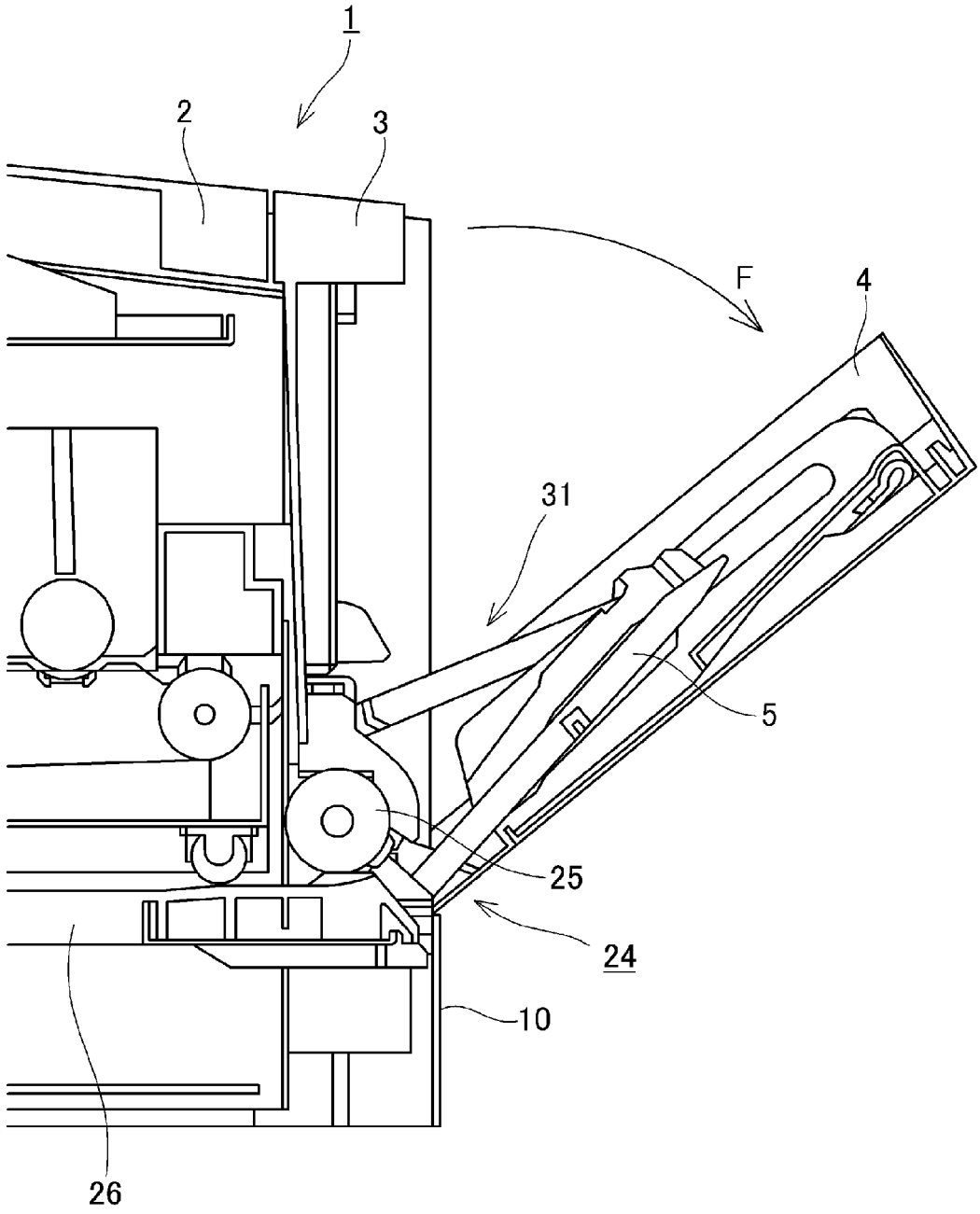
FIG. 10 is a schematic cross-sectional diagram illustrating the state during a manual feeding operation in Embodiment 2.

FIG. 8 is a schematic perspective-view diagram illustrating the exterior of the image-forming apparatus of the present embodiment. FIG. 9 is a cross-sectional diagram illustrating the schematic configuration of the image-forming apparatus of the present embodiment. FIG. 10 is a schematic cross-sectional diagram illustrating the state of the image-forming apparatus of the present embodiment at the time of a manual feeding operation.

As illustrated in FIG. 9, the manual feeding unit 24 is disposed on the front face side of the apparatus body 2. In the image-forming apparatus 1 of the present embodiment, the manual feeding door 4 is rotatably provided outward of the door 3 that covers the opening 30 of the apparatus body 2.

A manual feeding tray 5, provided so as to be movable with respect to the manual feeding door 4, is housed inside the door 3. When the manual feeding door 4 is opened in the direction of arrow F (front face direction) in FIG. 10, the manual feeding tray 5 moves to a manual feeding-enabling position.

During a manual feeding operation, the recording material S that is stacked on the manual feeding tray 5 is separated, sheet by sheet, by the manual feeding roller 25 and is fed into the apparatus body 2, at a predetermined control timing. The recording material S passes between a plurality of transport roller pairs, and is introduced into the secondary transfer portion that is the contact region of the secondary transfer roller 14 and the transfer belt 12. The features of the subsequent image-forming operation are identical to those of Embodiment 1.

<Double-Door Hinge Configuration>

A double-door hinge configuration of the door 3 and the manual feeding door 4 is explained next.

Figure 11A:
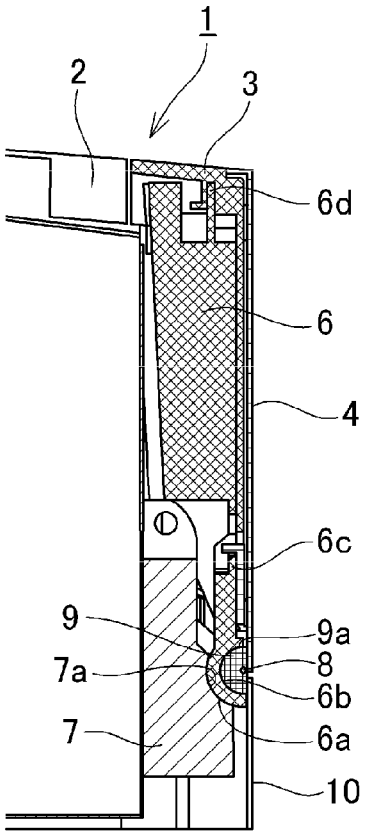
FIG. 11A is a set of diagrams illustrating a hinge portion with both a door and a manual feeding door of Embodiment 2 in a closed state.
Figure 11B:
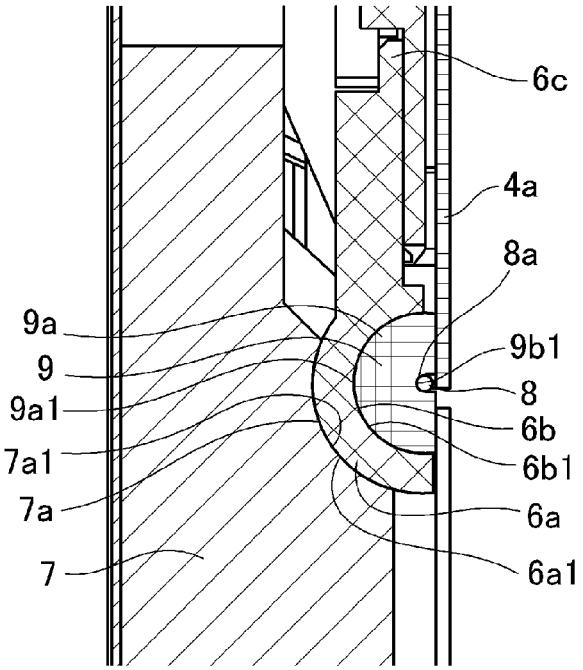
FIG. 11B is a set of diagrams illustrating a hinge portion with both a door and a manual feeding door of Embodiment 2 in a closed state.
Figure 12A:
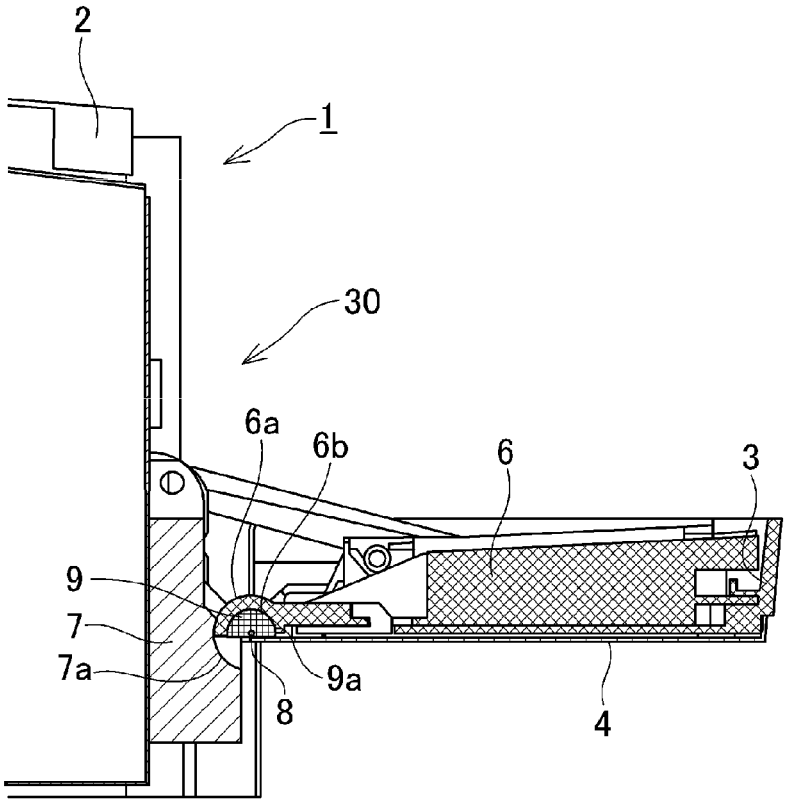
FIG. 12A is a set of diagrams illustrating a hinge portion with both the door and the manual feeding door of Embodiment 2 in an open state.
Figure 12B:
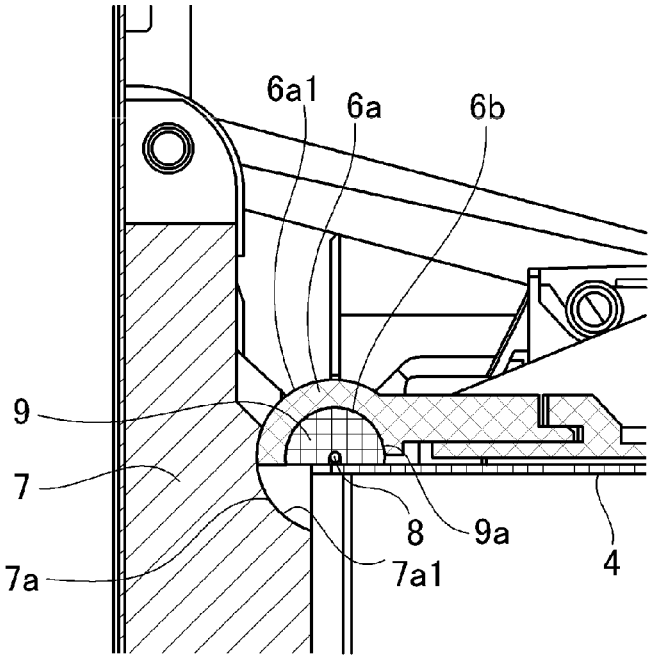
FIG. 12B is a set of diagrams illustrating a hinge portion with both the door and the manual feeding door of Embodiment 2 in an open state.
Figure 13A:
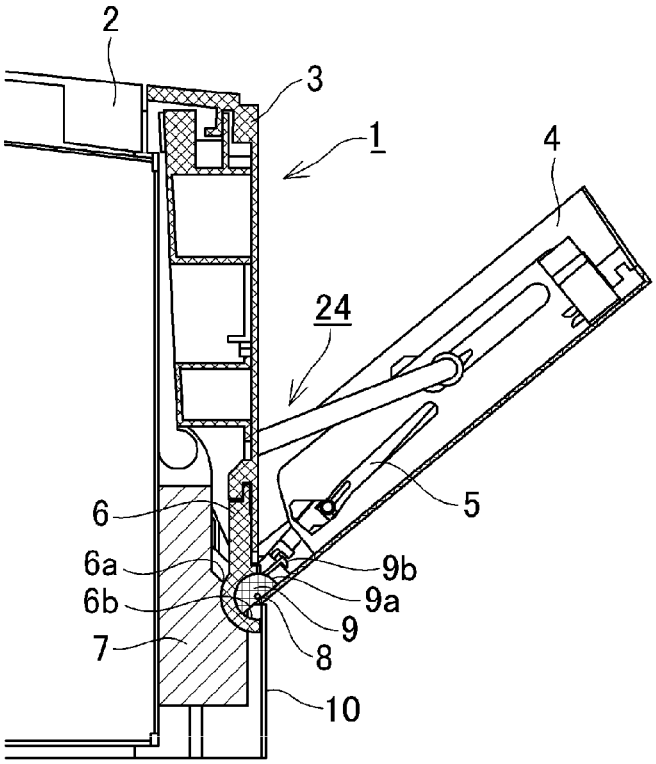
FIG. 13A is a set of diagrams illustrating a hinge portion with only the manual feeding door of Embodiment 2 in an open state.
Figure 13B:
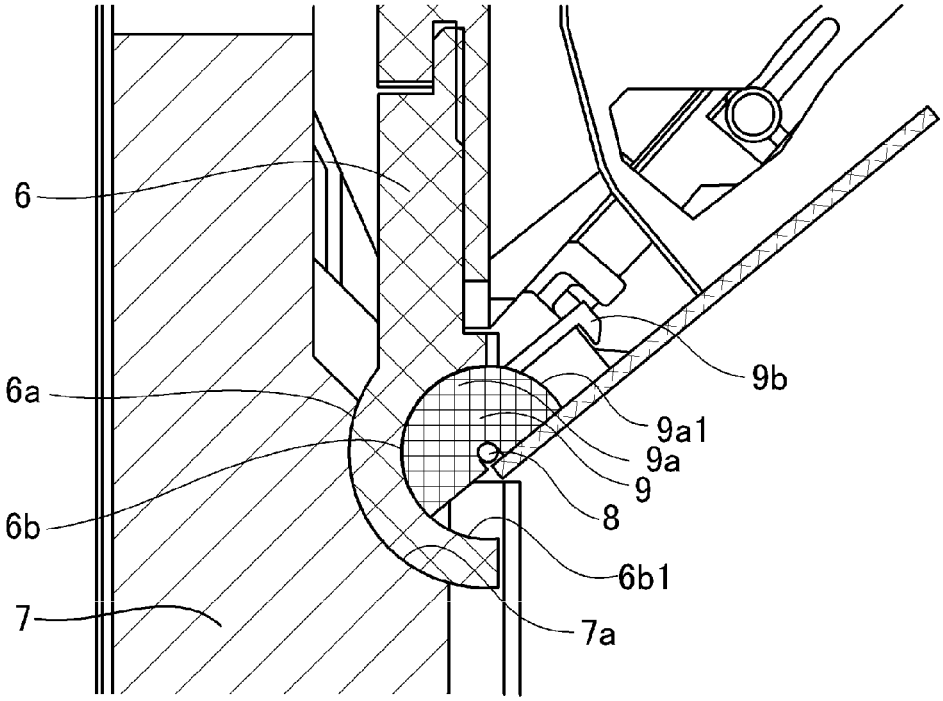
FIG. 13B is a set of diagrams illustrating a hinge portion with only the manual feeding door of Embodiment 2 in an open state.

FIG. 11A is a schematic cross-sectional diagram illustrating a hinge portion with both the door 3 and the manual feeding door 4 in a closed state. FIG. 11B is an enlarged diagram of the hinge portion illustrated in FIG. 11A. FIG. 12A is a schematic cross-sectional diagram illustrating a hinge portion with both the door 3 and the manual feeding door 4 in an open state. FIG. 12B is an enlarged diagram of the hinge portion illustrated in FIG. 12A. FIG. 13A is a schematic cross-sectional diagram illustrating the hinge portion in a state where the manual feeding door 4 alone is opened to enable a manual feeding operation. FIG. 13B is an enlarged diagram of the hinge portion illustrated in FIG. 13A.

In the present embodiment, the hinge configuration of the door 3 on the apparatus body 2 is identical to that of Embodiment 1. As illustrated in FIG. 11A through FIG. 13B, specifically, the support member 7 on which the door 3 is rotatably supported is mounted on the apparatus body 2. The depressed portion 7*a* having a circular arc-shaped cross-section is provided in the support member 7. The door 3 is provided with the door hinge member 6 having the protruded portion 6*a* the cross-section whereof is of circular arc shape, and with the engaging protrusions 6*c*, 6*d*. The door hinge member 6 is fixed to the door 3 using the engaging protrusions 6*c*, 6*d*. The protruded portion 6*a* of the door hinge member 6 is rotatably engaged with, and supported on, the depressed portion 7*a* of the support member 7; as a result there is formed a first engagement portion (first hinge portion that makes the door 3 rotatable with respect to the apparatus body 2).

The door hinge member 6 and the support member 7 in the hinge portion of the above-described Embodiment constitute the first hinge portion in the present embodiment. In the present embodiment the door hinge member 6 corresponds to a first door-side member. The protruded portion 6*a* corresponds to a first protruded portion such that the shape of the cross-section thereof perpendicular to the first rotation axis during rotation of the door hinge member 6 is a circular arc shape that bulges towards the apparatus body 2, with the door 3 in a closed state. The depressed portion 7*a* corresponds to a first depressed portion such that the shape of the cross-section thereof perpendicular to the first rotation axis is a circular arc shape, and the depressed portion has an inner peripheral face against which the outer peripheral face of the protruded portion 6*a* rotatably contacts. An outer peripheral face (guided surface) 6*a*1 of the protruded portion 6*a* rotatably contacts the inner peripheral face (first guiding surface) 7*a*1 of the depressed portion 7*a*, as a result of which the protruded portion 6*a* and the depressed portion 7*a* are brought to an engaged state, and the door 3 is brought to a state of being rotatably supported on the apparatus body 2 (FIG. 12).

In the door hinge member 6 of the present embodiment, a depressed portion 6*b* having a circular arc shape (substantially half-moon shape in the present embodiment) that is formed coaxially with the circular arc shape of the protruded portion 6*a* (first engagement portion), is provided on the rear surface of the face at which the circular arc-shaped protruded portion 6*a* is provided. The manual feeding door 4 comprises a door hinge member 9 having a protruded portion 9*a* and an engaging protrusion 9*b* of circular arc shape (in the present embodiment, substantially half-moon shape). The door hinge member 9 is fixed to the manual feeding door 4 using the engaging protrusion 9*b*. The circular arc-shaped protruded portion 9*a* of the door hinge member 9 is rotatably engaged with, and supported on, the circular arc-shaped depressed portion 6*b* of the door hinge member 6; as a result there is formed a second engagement portion (second hinge portion that makes the manual feeding door 4 rotatable with respect to the door 3).

In the present embodiment, the door hinge member 9 corresponds to a second door-side member, such that the door hinge member 6, the door hinge member 9 and the wire member 8 make up the second hinge portion. The protruded portion 9*a* corresponds to a second protruded portion such that the shape of the cross-section thereof perpendicular to the second rotation axis upon rotation of the door hinge member 9 (in the present embodiment, coaxially to the first rotation axis) is a circular arc shape that bulges towards the apparatus body 2, with the manual feeding door 4 in a closed state. The depressed portion 6*b* corresponds to a second depressed portion such that the shape of the cross-section thereof perpendicular to the second rotation axis is a circular arc shape, and the depressed portion has an inner peripheral face against which the outer peripheral face of the protruded portion 9*a* rotatably contacts. In the door hinge member 6, the inner peripheral face of the depressed portion 6*b* is disposed on the inner peripheral side of the outer peripheral face of the protruded portion 6*a*. An outer peripheral face (second contact surface) 9*a*1 of the protruded portion 9*a* rotatably contacts the inner peripheral face (first contact surface) 6*b*1 of the depressed portion 6*b*, as a result of which the protruded portion 9*a* and the depressed portion 6*b* are brought to an engaged state. The second guided surface 9*b*1 of the door hinge member 9 rotatably contacts the surface (second guiding surface) 8*a* of the wire member 8. As a result, the manual feeding door 4 is brought to a state of being rotatably supported on the door 3 (FIG. 13).

The wire member 8, which is configured (disposed) coaxially with the circular arc shape of the first engagement portion and the second engagement portion, i.e. the circular arc shape of the depressed portion 7*a*, the protruded portion 6*a*, the depressed portion 6*b* and the protruded portion 9*a* (so as to have the same rotation axis (rotation center)), is held by the support member 7. The wire member 8 corresponds to a second shaft member that rotatably connects the manual feeding door 4 to the door 3. The protruded portion 9*a*, as a second protruded portion, doubles also as a first shaft member that rotatably connects the door 3 to the apparatus body 2. The outer peripheral face 6*a*1, the inner peripheral face 6*b*1, the inner peripheral face 7*a*1, the outer peripheral face 9*a*1, the second guided surface 9*b*1 and the surface 8*a* of the wire member are concentric circular arc surfaces centered on the axis line (predetermined rotation center) of the wire member 8.

The wire member 8 is held, on the support member 7, in a state of being disposed in such a manner so as to prevent disengagement between the protruded portion 9*a* of the door hinge member 9 and the depressed portion 6*b* of the door hinge member 6, and disengagement of the protruded portion 6*a* of the door hinge member 6 and the depressed portion 7*a* of the support member 7.

The two end portions of the wire member 8 are disposed so as to thrust into the hole 7*b* that is provided in the support member 7, so that the orientation of the wire member 8 is fixedly supported as a result on the support member 7.

A cover 4*a* of the manual feeding door 4 covers a position opposite the second guided surface 9*b*1, across the wire member 8. The cover 4*a* prevents the second guided surface 9*b*1 from moving away from the wire member 8 and prevents the manual feeding door 4 from coming off the apparatus body 2.

By virtue of the above configuration, the door 3 can execute a smooth opening and closing operation with respect to the apparatus body 2, as illustrated in FIG. 12, with the rotation shaft (axis line of the wire member 8) formed by the first engagement portion, the second engagement portion and the wire member 8 as a rotation center. Further, the manual feeding door 4 can execute a smooth opening and closing operation with respect to the apparatus body 2, as illustrated in FIG. 13, with the rotation shaft (axis line of the wire member 8) formed by the second engagement portion and the wire member 8 as a rotation center.

As described in Embodiment 1, the present embodiment allows making the rotation trajectory J1 of entry into the interior of the apparatus body smaller than the rotation trajectory J2 of a conventional door 3, also when the door 3 and the manual feeding door 4 are opened and closed.

Accordingly, no constraints need be imposed on the relationship between the position of the hinge and the arrangement of the manual feeding unit 24 that is provided in the apparatus body 2, and hence the door 3 and the manual feeding door 4 can be opened and closed smoothly, and the size of the apparatus body 2 can be reduced. Further, the clearance L1 with respect to the adjacent exterior part 10 can be made smaller than the conventional clearance L2. The exterior of the apparatus body can therefore be further improved. That is, the present embodiment elicits the same effect as Embodiment 1.

In the present embodiment, the rotation axis during rotation of the door hinge member 6 (rotation axis (center axis) of the circular arc shape (outer peripheral face) of the protruded portion 6*a*, first rotation axis) and the rotation axis upon rotation of the door hinge member (rotation axis of circular arc-shape of the protruded portion 9*a*, second rotation axis) were set to be coaxial. The protruded portion 9*a*, as the second protruded portion, served also as the first shaft member that rotatably connects the door 3 to the apparatus body 2. However, the present embodiment is not limited thereto. The rotation axis upon rotation of the door hinge member 6 and the rotation axis upon rotation of the door hinge member 9 need not be coaxial. That is, it suffices that the hinge portion by way of which the door 3 is rotatably supported on the apparatus body 2, and the hinge portion by way of which the manual feeding door 4 is rotatably supported on the door 3, adopt a configuration such as following one. Specifically, it suffices that each hinge portion be configured out of a hinge constituent member having a protruded portion, a hinge constituent member provided with a depressed portion that has an inner peripheral face against which the outer peripheral face of the protruded portion rotatably contacts, and a shaft member that rotatably connects the two hinge constituent members relatively to each other.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2012-254296, filed Nov. 20, 2012 and No. 2013-230190, filed Nov. 6, 2013 which are hereby incorporated by reference herein in their entirety.

What is claimed is:

1. An opening and closing mechanism comprising:

an apparatus body;

an opening and closing member that opens and closes by rotating with respect to said apparatus body; and a rod-like metal shaft member that is mounted in said apparatus body, wherein said opening and closing member is rotatably supported about said metal shaft member through insertion of said opening and closing member between a guiding surface having a circular arc surface shape provided in said apparatus body, and a surface of said metal shaft member, wherein said opening and closing member comprises a first guided surface that contacts said guiding surface and a second guided surface that contacts said metal shaft member, and wherein said opening and closing member comprises a cover member that covers a position opposing said second guided surface across said metal shaft member.

2. The opening and closing mechanism according to claim 1, wherein said guiding surface is a circular arc surface centered on an axis line of said metal shaft member.

3. An opening and closing mechanism comprising:

an apparatus body; and first and second opening and closing members that open and close by rotating with respect to said apparatus body, wherein said apparatus body has first and second guiding surfaces having circular arc surface shapes respectively, said first opening and closing member has a first guided surface that contacts said first guiding surface and a first contact surface that contacts said second opening and closing member, and said second opening and closing member has a second guided surface that contacts said second guiding surface and a second contact surface that contacts said first opening and closing member, and wherein said first and second guiding surfaces, said first and second guided surfaces, and said first and second contact surfaces are formed in a concentric circular arc surface shape centered on a predetermined rotation center, and said first and second opening and closing members are rotatably supported about said predetermined rotation center through insertion of said first and second opening and closing members between said first and second guiding surfaces.

4. The opening and closing mechanism according to claim 3, further comprising:

a rod-like metal shaft member that is mounted in said apparatus body;

wherein said second guiding surface is a surface of said metal shaft member, and an axis line of said metal shaft member is said predetermined rotation center.

5. The opening and closing mechanism according to claim 4, wherein said opening and closing member comprises a cover member that covers a position opposing said second guided surface, across said metal shaft member.

6. An image-forming apparatus comprising:

an apparatus body;

an opening and closing member that opens and closes by rotating with respect to said apparatus body; and a rod-like metal shaft member that is mounted in said apparatus body, wherein said opening and closing member is rotatably supported about said metal shaft member through insertion of said opening and closing member between a guiding surface having a circular arc surface shape provided in said apparatus body, and a surface of said metal shaft member, wherein said opening and closing member comprises a first guided surface that contacts said guiding surface and a second guided surface that contacts said metal shaft member, and wherein said opening and closing member comprises a cover member that covers a position opposing said second guided surface across said metal shaft member.

7. The image-forming apparatus according to claim 6, wherein said guiding surface is a circular arc surface centered on an axis line of said metal shaft member.

8. The image-forming apparatus according to claim 6, wherein a cartridge can be detachably attached to said apparatus body, and said cartridge can be inserted into said apparatus body, or retrieved from said apparatus body, through opening of said opening and closing member.

9. An image-forming apparatus comprising:

an apparatus body; and first and second opening and closing members that open and close by rotating with respect to said apparatus body, wherein said apparatus body has first and second guiding surfaces having circular arc surface shapes respectively, said first opening and closing member has a first guided surface that contacts said first guiding surface and a first contact surface that contacts said second opening and closing member, and said second opening and closing member has a second guided surface that contacts said second guiding surface and a second contact surface that contacts said first opening and closing member, and wherein said first and second guiding surfaces, said first and second guided surfaces, and said first and second contact surfaces are formed in a concentric circular arc surface shape centered on a predetermined rotation center, and said first and second opening and closing members are rotatably supported about said predetermined rotation center through insertion of said first and second opening and closing members between said first and second guiding surfaces.

10. The image-forming apparatus according to claim 9, further comprising:

a rod-like metal shaft member that is mounted in said apparatus body, wherein said second guiding surface is a surface of said metal shaft member, and an axis line of said metal shaft member is said predetermined rotation center.

11. The image-forming apparatus according to claim 10, wherein said opening and closing member comprises a cover member that covers a position opposing said second guided surface, across said metal shaft member.

12. The image-forming apparatus according to claim 9, wherein a cartridge can be detachably attached to said apparatus body, and said cartridge can be inserted into said apparatus body, or retrieved from said apparatus body, through opening of said first and second opening and closing members.

13. The image-forming apparatus according to claim 9, wherein said second opening and closing member comprises a loading portion loading thereon a recording material, on which an image is to be formed, without opening of said first opening and closing member and with said second opening and closing member in an open state.

14. The image-forming apparatus according to claim 6, wherein said metal shaft member has a first portion contacting said second guided surface, and a second portion thrusting into a hole that is provided in said apparatus body at a position that is farther from an exterior surface of said apparatus body than a contacting position of said second guided surface and said first portion and supporting said metal shaft member with respect to said apparatus body.

15. The image-forming apparatus according to claim 6, wherein said opening and closing member is provided on a front face side of said apparatus body, and is rotatably supported about a rotation axis extending through a lowest portion of said opening and closing member in a closed state.

16. The image-forming apparatus according to claim 6, wherein said opening and closing member is provided above an exterior member that makes up an exterior of said apparatus body.

17. The image-forming apparatus according to claim 16, wherein said exterior member is a cover for an accommodating portion of said apparatus body wherein a recording material is accommodated.

18. The image-forming apparatus according to claim 6, wherein an axis line of said metal shaft member is in a horizontal direction.

* * * * *